US011913323B2

(12) United States Patent
Snyder

(10) Patent No.: US 11,913,323 B2
(45) Date of Patent: Feb. 27, 2024

(54) DESANDER ASSEMBLY FOR PLUNGER LIFT SYSTEM

(71) Applicant: Daniel J. Snyder, Edmond, OK (US)

(72) Inventor: Daniel J. Snyder, Edmond, OK (US)

( * ) Notice: Subject to any disclaimer, the term of this patent is extended or adjusted under 35 U.S.C. 154(b) by 0 days.

(21) Appl. No.: 18/165,765

(22) Filed: Feb. 7, 2023

(65) Prior Publication Data

US 2023/0250716 A1 Aug. 10, 2023

Related U.S. Application Data

(60) Provisional application No. 63/307,354, filed on Feb. 7, 2022.

(51) Int. Cl.
*E21B 43/38* (2006.01)
*E21B 21/10* (2006.01)

(52) U.S. Cl.
CPC ..... *E21B 43/38* (2013.01); *E21B 21/103* (2013.01)

(58) Field of Classification Search
CPC ..... E21B 43/38; E21B 21/103
USPC ..... 166/265
See application file for complete search history.

(56) References Cited

U.S. PATENT DOCUMENTS

| | | | | |
|---|---|---|---|---|
| 4,148,735 | A | 4/1979 | Laval, Jr. | |
| 5,295,537 | A | 3/1994 | Trainer | |
| 5,553,669 | A | 9/1996 | Trainer | |
| 5,662,167 | A | 9/1997 | Patterson et al. | |
| 5,810,081 | A * | 9/1998 | Cobb | E21B 17/00 166/105.3 |
| 6,216,788 | B1 | 4/2001 | Wilson | |
| 6,672,335 | B1 | 1/2004 | Welborn | |
| 10,760,398 | B2 | 9/2020 | Webber et al. | |
| 2012/0273278 | A1 | 11/2012 | Zhu | |
| 2014/0174734 | A1 | 6/2014 | Gill et al. | |
| 2017/0058651 | A1 * | 3/2017 | Damiano | F04B 47/12 |
| 2017/0096884 | A1 * | 4/2017 | Michel | F04B 53/14 |

(Continued)

FOREIGN PATENT DOCUMENTS

| | | |
|---|---|---|
| CN | 109356832 | 2/2019 |
| WO | WO 2011/009145 | 1/2011 |

OTHER PUBLICATIONS

International Search Report and Written Opinion (PCT/US2023/062142); dated May 26, 2023 ; 14 pgs.

*Primary Examiner* — William D Hutton, Jr.
*Assistant Examiner* — Ashish K Varma
(74) *Attorney, Agent, or Firm* — Dunlap Codding, P.C.

(57) ABSTRACT

A desander assembly retrievably positionable in a tubing string including a fishing neck, a bypass tool, a stop assembly configured to retrievably mate with a portion of the tubing string, an outer tubular member, and an inner tubular member. The outer tubular member has at least one aperture extending. The inner tubular member is positioned in the outer tubular member to form an annulus and so a bore of the inner tubular member is in fluid communication with the bypass tool. The inner tubular member has at least one spiral protrusion extending outwardly from the sidewall to cooperate with an interior side of the outer tubular member to form a spiral channel. The bore of the inner tubular member receives reservoir fluid that passes into the annulus formed between the inner tubular member and the outer tubular member via the apertures of the outer tubular member.

20 Claims, 8 Drawing Sheets

(56) References Cited

U.S. PATENT DOCUMENTS

| | | | | |
|---|---|---|---|---|
| 2020/0392828 | A1* | 12/2020 | Raglin | B01D 33/275 |
| 2021/0102448 | A1* | 4/2021 | Fraser | E21B 43/127 |

* cited by examiner

DESANDER ASSEMBLY FOR PLUNGER LIFT SYSTEM

CROSS-REFERENCE TO RELATED APPLICATIONS

This application claims the benefit of U.S. Provisional Application No. 63/307,354, filed Feb. 7, 2022, which is hereby incorporated herein by reference in its entirety.

BACKGROUND

Plunger lift systems are used in oil and gas wells when the bottom hole pressure decreases to a point fluid cannot be effectively lifted to the surface. A plunger lift system utilizes a piston-like object known as a plunger. The plunger is placed inside the production tubing, and by controlling the pressure in the production tubing, the plunger is caused to move up and down the tubing. A valve at the surface is operated to control the pressure. When the valve is closed, the pressure increases so when the valve is opened, the plunger is caused to rise to the top carrying the fluids to the surface. When the valve is closed, the plunger returns to the bottom.

A lubricator is a piping arrangement installed at the surface to capture the plunger when the plunger is in the top position. The lubricator includes fluid outlets connected to surface piping and a bumper spring. The lubricator's bumper spring absorbs the plunger's impact force upon the plunger arriving at the top position. The lubricator may include one or more catchers adapted to hold the plunger within the lubricator selectively.

Another bumper spring is positioned at the bottom of the tubing to absorb the impact force of the plunger upon the plunger falling to the bottom. The bumper spring is generally part of a bottom hole spring assembly, which may include a spring, a fishing neck, a bypass tool, and a setting tool for securing the bottom hole spring assembly relative to the production tubing.

With many production systems that use an artificial lift system, problems can arise when sand and other solid debris infiltrate the system. On shutdown, flow ceases quickly as the fluid levels in the production bore and the annulus equalize. Gravity acting on sand particles in the column of fluid above the plunger (which could be several thousand feet) causes the sand and other solids to fall back toward the plunger. During production, sand particles can cause damage or premature wear to the plunger and even cause the plunger to seize. Such failure can require additional working over and may require pulling the tubing out and reinstallation. At other times, a wireline can be used to remove the failed plunger. This is an expensive and time-consuming operation.

To this end, a need exists for a desander assembly with a plunger lift system to prevent or reduce the number of solids from reentering into the plunger lift system and which is easy to install into and retrieve from the tubing string. It is to such an apparatus that the inventive concepts disclosed herein are directed.

DETAILED DESCRIPTION OF EXEMPLARY EMBODIMENTS

Figure 1:
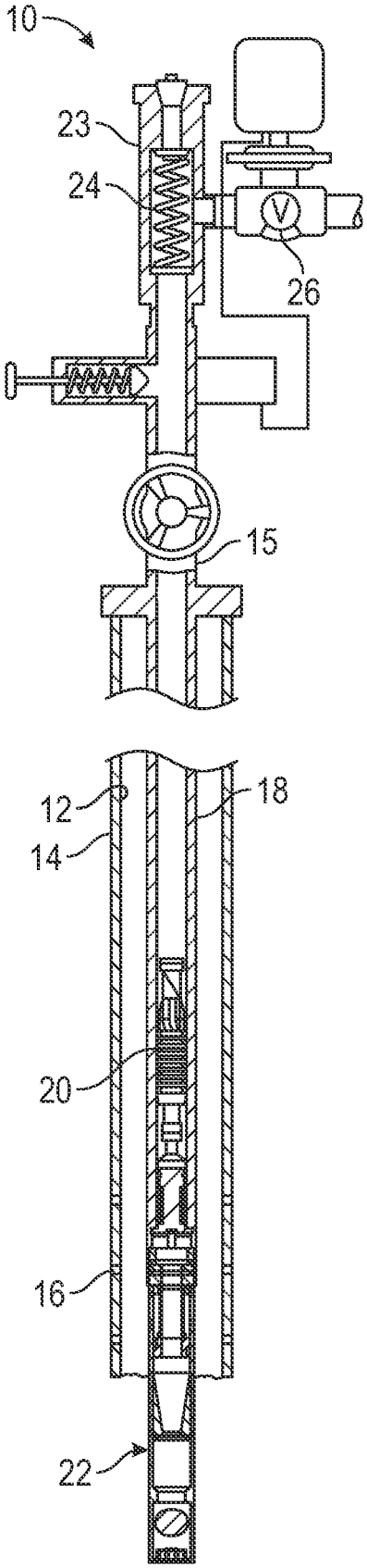
FIG. 1 is a sectional view of a plunger lift system for removing fluid from a wellbore illustrating a desander assembly incorporated into the plunger lift system and a plunger at the bottom of the wellbore.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
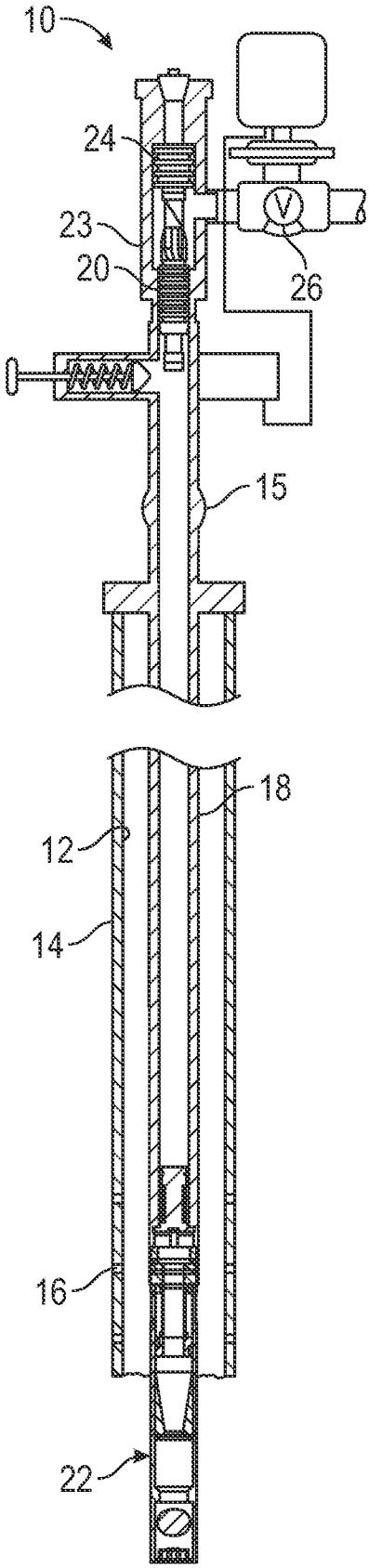
FIG. 2 is a sectional view of the plunger lift system of FIG. 1 illustrating the plunger at the top of the wellbore.

Referring now to the drawings, and in particular to FIGS. 1 and 2, a plunger lift system 10 for removing fluid, such as oil and water, from a wellbore 12 is schematically illustrated. The wellbore 12 is lined with a casing 14 extending downwardly from a wellhead 15. The casing 14 provides a permanent borehole through which production operations may be conducted. The casing 14 is affixed in the wellbore 12 in a conventional manner, such as by cement (not shown), and is provided with perforations 16 open to a producing subterranean formation (also not shown).

The plunger lift system 10 includes a tubing string 18, a plunger 20, a desander assembly 22, a lubricator 24, and a control valve 26. The tubing string 18 provides fluid communication between the producing subterranean formation and the surface so a reservoir fluid (not shown), for example, water and/or oil and/or natural gas, is produced through the tubing string 18. The casing 14 and the tubing string 18 define an annulus 19, which also provides fluid communication through the wellbore 12.

The plunger 20 may be any type of plunger, such as a bypass plunger of the type including a body and a shift valve, which, when open, allows fluid to pass through the plunger 20 and thereby increase the velocity of the plunger 20 as the plunger 20 travels down the tubing string 18. The plunger 20 is dropped into the tubing string 18. When the control valve 26 is closed, pressure may build, so when the control valve 26 is opened, the plunger 20 rises to the lubricator 24 carrying the fluids to the surface. The plunger 20 returns to the bottom when the control valve 26 is closed. Through operation of the control valve 26, a liquid slug is cyclically brought to the surface of the wellbore 12 from stored gas pressure. In the off cycle, the plunger 20 falls, and pressure builds again in the wellbore 12.

Figure 3:
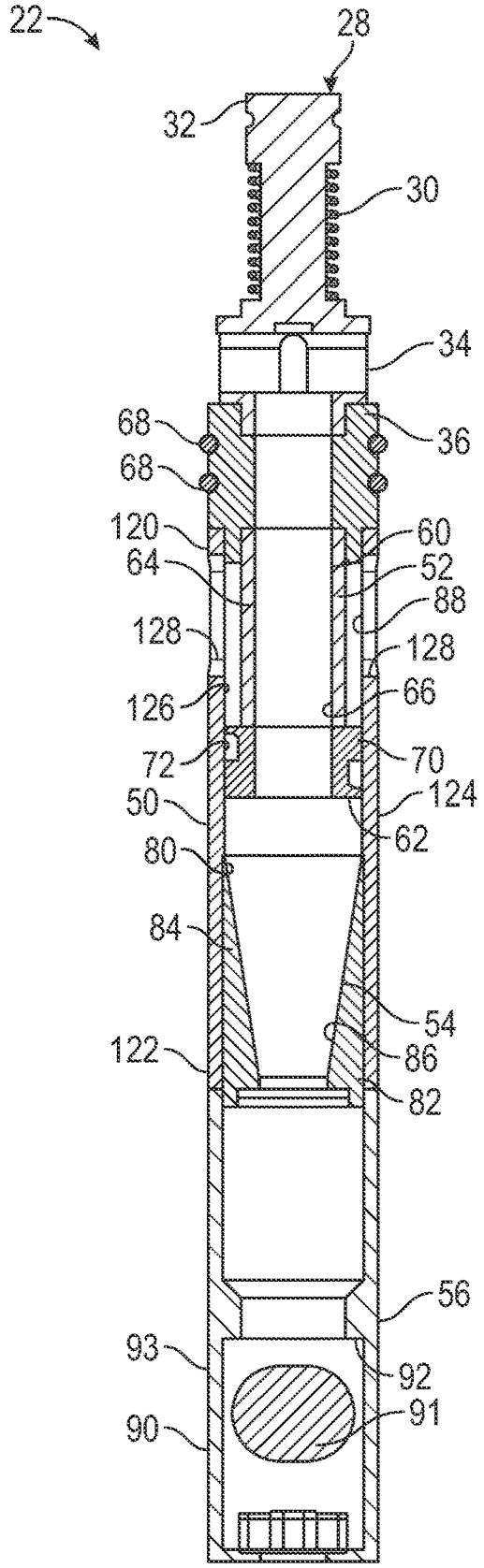
FIG. 3 is a sectional view of the desander assembly.

As further stated above, problems can arise when the plunger lift assembly 10 is exposed to sand and other solid particles. With reference to FIG. 3, the desander assembly 22, constructed in accordance with inventive concepts disclosed herein, is shown to include a bottom bumper assembly 28 so the desander assembly 22 is positioned to separate sand and other solids entering the tubing string 14 and thereby reduce the amount of sand and solids entering the plunger lift system 10. It will be understood by those of ordinary skill in the art that a variety of bottom bumper assemblies exist and the desander assembly 22 may be configured to be incorporated with many designs and constructs of a bottom bumper assembly. In one embodiment, the bottom bumper assembly 28 may include a spring 30, a fishing neck 32, a cage or bypass tool 34, and a stop assembly 36, such as a seat cup, a collar stop, a tubing stop, or a collet latch. The spring 30 is positioned between the fishing neck 32 and the bypass tool 34 to permit reciprocating movement of the fishing neck 32 relative to the bypass tool 34 to absorb the impact force of the plunger 20 upon the plunger 20 falling to the bottom position. The stop assembly 36 may include at least one seal 68 to form a fluid-tight seal between the desander assembly 22 and the tubing string 14. The stop assembly 36 may be configured to retrievably mate with a profile nipple of the tubing string or in a collar stop, tubing stop, or hold down device as used in lieu of a profile nipple. As known, a standing valve (not shown) may be incorporated into the cage 34. Because bottom bumper assemblies are well known in the art, no further description thereof is deemed necessary for one skilled in the art to implement the exemplary embodiments of the desander assembly 22.

Still, with reference to FIG. 3, the desander assembly 22 further includes an outer tubular member 50, an inner outer tubular member 52, a funnel section 54, and a collection section 56.

The outer tubular member 50 has an upper end 120, a lower end 122, and a sidewall 124 defining a chamber 126 extending between the upper end 120 and the lower end 122. The upper end 120 of the tubular member 50 is connected to a lower end of the stop assembly 36. The outer tubular member 50 has at least one aperture 128 extending therethrough near the upper end 120 thereof. The apertures 128 receive reservoir fluid from the reservoir.

The inner outer tubular member 52 has an upper end 60, a lower end 62, and a sidewall 64 defining a bore 66 extending between the upper end 60 and the lower end 62. The upper end 60 of the inner outer tubular member 52 is configured to be connected to a lower portion of the stop assembly 36 of the bottom bumper assembly 28 so the bore 66 is in fluid communication with the bottom bumper assembly 28.

The inner outer tubular member 52 has at least one spiral protrusion 70 extending outwardly from the sidewall 64 to cooperate with an interior side of the outer tubular member 50 to form a spiral channel 72. The spiral protrusion 70 may be formed in various shapes and angles. Additionally, more than one spiral protrusion may be employed.

The funnel section 54 is a tubular member with an upper end 80, a lower end 82, and a sidewall 84 defining a funnel-shaped bore 86 extending between the upper end 80 and the lower end 82. The funnel section 54 is configured to be inserted into a lower portion of the outer tubular member 50 or incorporated as a part of the outer tubular member 50.

The reservoir fluid passes through the apertures 128 of the outer tubular member 50 into an annulus 88 formed by the inner outer tubular member 52 and the outer tubular member 50. The reservoir fluid is guided downwardly into the spiral channel 72 formed by the spiral protrusion 70 and the interior side of the outer tubular member 50. The spiral channel 72 induces a cyclonic flow to the reservoir fluid, which causes heavier particles, such as sand and other solids, to be forced outwardly and fall to the lower end 82 of the outer tubular member 50. The separated fluid flows into the bore 66 of the inner outer tubular member 52 via the lower end 62 of the inner outer tubular member 52. The fluid continues to travel up through the bore 66 of the inner outer tubular member 52 and exits from the bottom bumper assembly 28 via the cage 28 of the bottom bumper assembly 28. The funnel-shaped bore 86 of the funnel section 54 promotes continued cyclonic flow of the solids.

The sand and solids from the funnel section 54 may pass into the collector section 56. In one embodiment illustrated in FIG. 3, the collector section 56 may be in the form of a dump valve or check valve 90 connected to the lower end 122 of the outer tubular member 50. When flow comes up from below the check valve 90, a valve member 91 engages a seat 92 of a cage 93 preventing the flow of fluid up the tubing string and directing the flow of fluid to the apertures 128 of the outer tubular member 50. When the flow of fluid stops, the valve member 91 drops to allow the passage of solids passing down through the desander assembly 22. This cycle will continue with the valve member 91 preventing flow directly up the tubing while preventing sand from entering the tubing string 14.

One of the features of the desander assembly 22 is that it may be retrieved from the tubing string 14 without requiring the tubing string 14 to be pulled from the wellbore. The desander assembly 22 may be retrieved from the tubing string 14 by latching onto the fishing neck 32 with a wireline or other suitable device.

Figure 4:
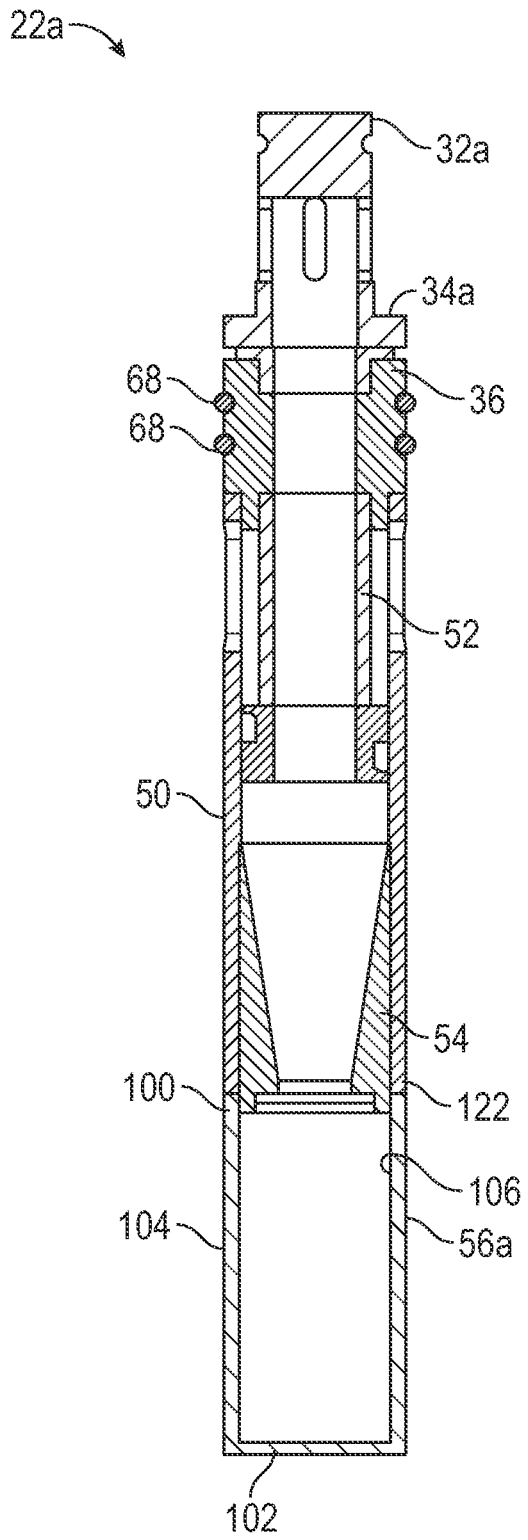
FIG. 4 is a sectional view of another embodiment of a desander assembly.

FIG. 4 illustrates another embodiment of a desander assembly 22*a*. The desander assembly 22*a* is similar in construction to the desander assembly 22 described above except as noted below. The desander assembly 22*a* includes no spring. The desander assembly 22*a* has a fishing neck 32*a*, a cage or bypass tool 34*a*, and a stop assembly 36*a*, such as a seat cup, a collar stop, a tubing stop, or a collet latch. The stop assembly 36*a* may include at least one seal 68*a* to form a fluid-tight seal between the desander assembly 22*a* and the tubing string 14. The stop assembly 36*a* may be configured to retrievably mate with a profile nipple of the tubing string or, alternatively, in a tubing or collar stop or hold down device as used in lieu of a profile nipple. As known, a standing valve (not shown) may be incorporated into the cage 34*a*. Because the desander assembly 22*a* includes no spring, the desander assembly 22*a* may be set in the tubing string 14 below a bottom bumper assembly (not shown) in a way that the desander assembly 22*a* and the bottom bumper assembly are separate from one another.

The desander assembly 22*a* has an outer tubular member 50, an inner outer tubular member 52, a funnel section 54, and a collector section 56*a*. The collector section 56*a* may be a tubular member having an upper end 100, a closed lower end 102, and a sidewall 104 defining a chamber 106 extending between the upper end 100 and the lower end 102. The upper end 100 of the collector section 56*a* is connected to the lower end 122 of the outer tubular member 50. In one version, the collector section 56*a* may have a length of approximately 32 feet or more. However, it will be appreciated that the length of the collector section 56*a* may be varied.

One of the features of the desander assembly 22*a* is that it may be retrieved from the tubing string 14 without requiring the tubing string 14 to be pulled from the wellbore. The desander assembly 22*a* may be retrieved from the tubing string 14 by latching onto the fishing neck 32*a* with a wireline or other suitable device.

Figure 5:
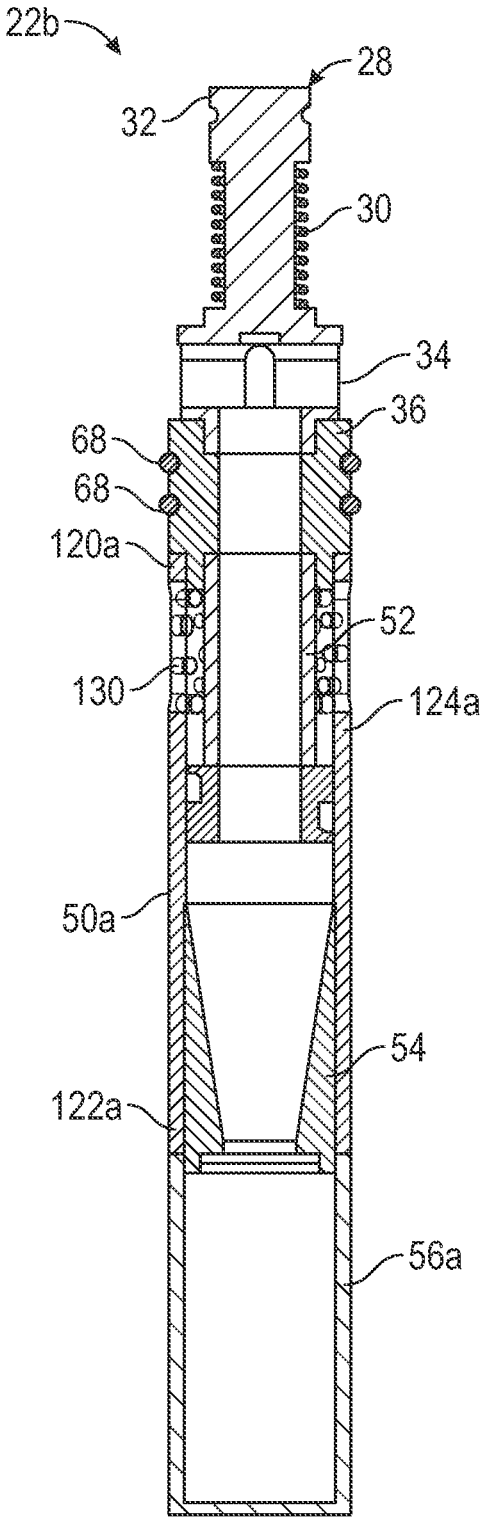
FIG. 5 is a sectional view of another embodiment of a desander assembly.

Referring now to FIG. 5, another embodiment of a desander assembly 22*b* is illustrated. The desander assembly 22*b* is similar to the desander assembly 22, except as noted below. The desander assembly 22*b* has an outer tubular member 50*a* with an upper end 120*a*, a lower end 122*a*, and a sidewall 124*a* defining a chamber 126*a* extending between the upper end 120*a* and the lower end 122*a*. The upper end 120*a* of the is connected to a lower end of the stop assembly 36. The outer tubular member 50*a* differs from the outer tubular member 50 because the outer tubular member 50*a* has a plurality of perforations 130 extending therethrough near the upper end 120*a* thereof. The perforations 120*a* receive reservoir fluid from the reservoir.

The desander assembly 22*b* is shown to include a collector section 56*a* described above. It will be appreciated that the desander assembly 22*b* may be configured alternatively to have a collector section 56.

One of the features of the desander assembly 22*b* is that it may be retrieved from the tubing string 14 without requiring the tubing string 14 to be pulled from the wellbore. The desander assembly 22*b* may be retrieved from the tubing string 14 by latching onto the fishing neck 32 with a wireline or other suitable device.

Figure 6:
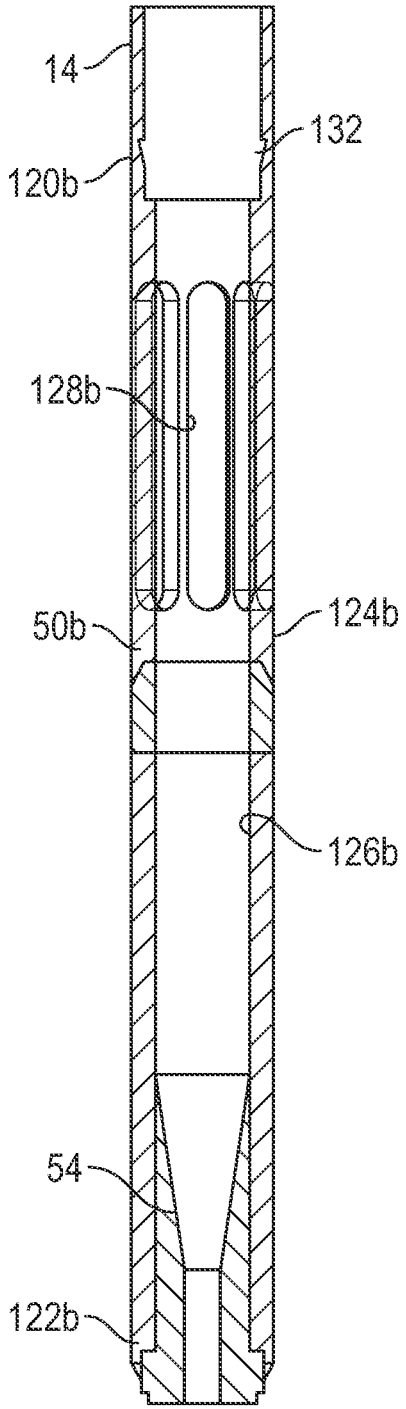
FIG. 6 is a sectional view of a portion of a tubing string.
Figure 7:
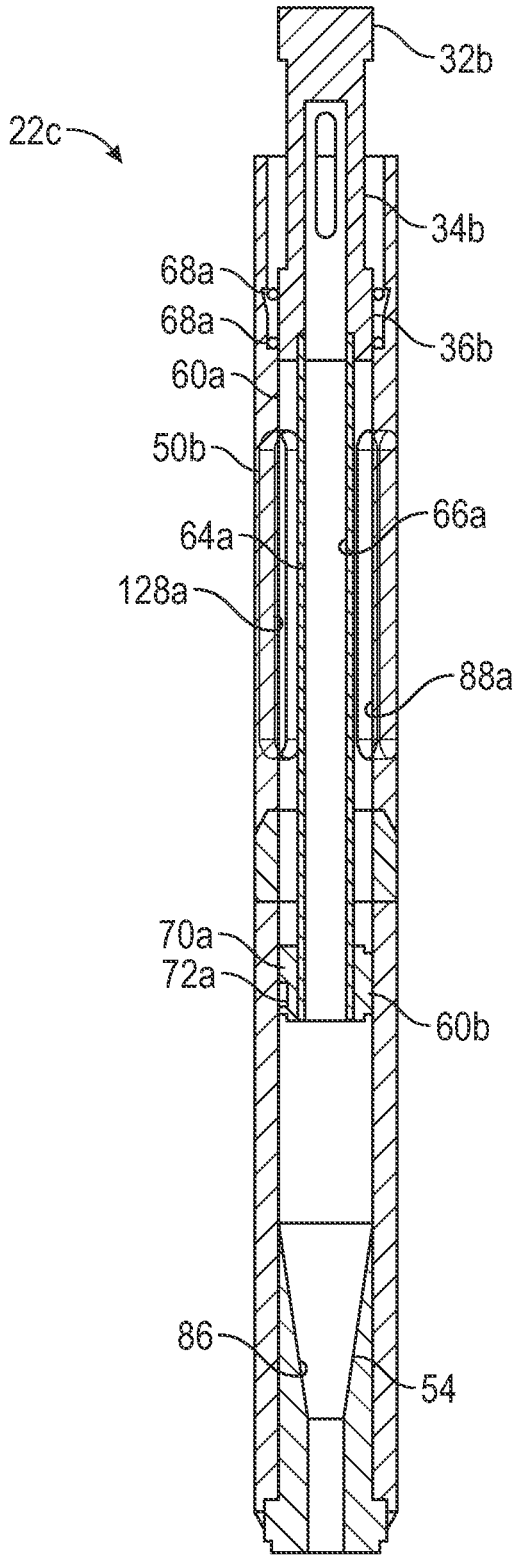
FIG. 7 is a sectional view of another embodiment of a desander assembly installed in the tubing string of FIG. 7.
Figure 8:
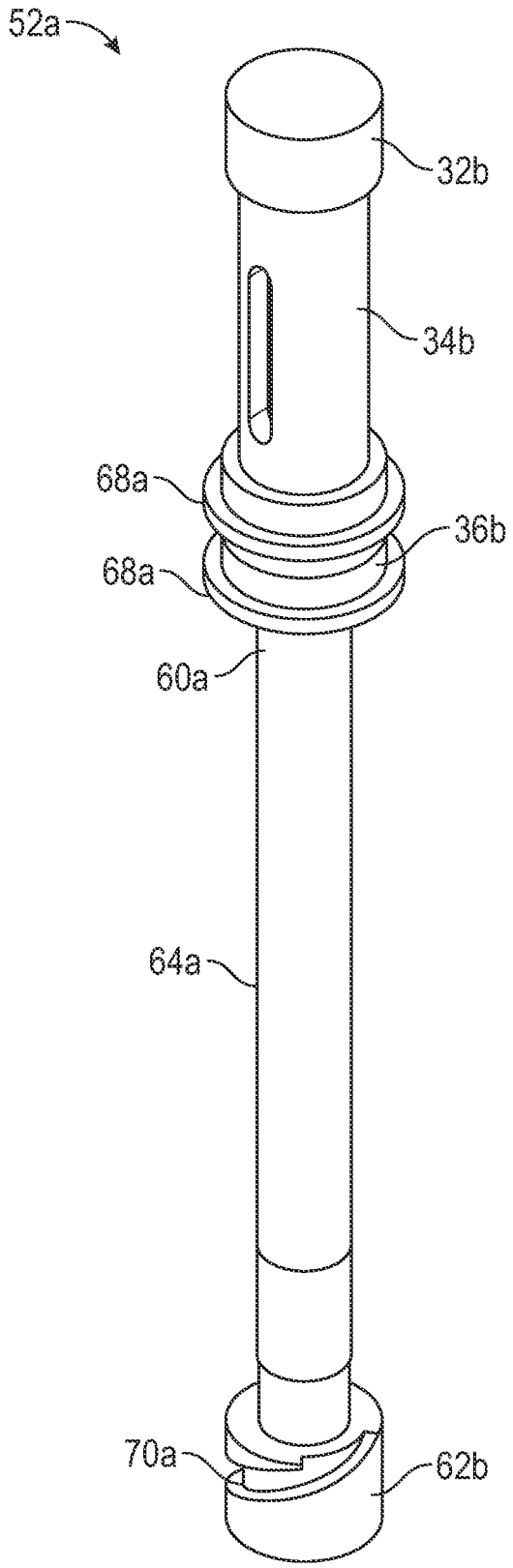
FIG. 8 is a perspective view of the desander assembly of FIG. 7.

Referring now to FIGS. 6-8, another embodiment of a desander assembly 22*c* is illustrated. The desander assembly 22*c* may include an outer tubular member 50*b*, an inner outer tubular member 52*a* (FIGS. 7 and 8), a funnel section 54, and a collection section (not shown).

The outer tubular member 50*b* is illustrated in FIG. 6. The outer tubular member 50*b* has an upper end 120*b*, a lower end 122*b*, and a sidewall 124*b* defining a chamber 126*b* extending between the upper end 120*b* and the lower end 122*b*. The upper end 120*b* of the outer tubular member 50*b* is connected to a portion of the tubing string 14, so the outer tubular member 50*b* is a part of the tubing string 14. The outer tubular member 50*b* has at least one aperture 128*b* extending therethrough near the upper end 120*b* thereof. The apertures 128*b* receive reservoir fluid from the reservoir.

The outer tubular member 50*b* may include a profile nipple 132, a seating nipple, or other suitable tool for retrievably supporting the inner outer tubular member 52*a*.

The funnel section 54 is configured to be inserted into a lower portion of the outer tubular member 50*b* or incorporated into the outer tubular member 50*b*.

The inner outer tubular member 52*a* (FIGS. 7 and 8) has an upper end 60*a*, a lower end 62*a*, and a sidewall 64*a* defining a bore 66*a* extending between the upper end 60*a* and the lower end 62*a*. The upper end 60*a* of the inner outer tubular member 52*a* may include a fishing neck 32*b*, a cage or bypass tool 34*b*, and a stop assembly 36*b*, such as a seat cup, a collar stop, a tubing stop, or a collet latch. The stop assembly 36*b* may include at least one seal 68*a* to form a fluid-tight seal between the inner outer tubular member 52*a* and the outer tubular member 50*b*. The stop assembly 36*b* may be configured to retrievably mate with the profile nipple 132 or, alternatively, in a tubing or collar stop or hold down device as used in lieu of a profile nipple. A standing valve (not shown) may be incorporated into the cage 34*b*.

The inner outer tubular member 52*a* has at least one spiral protrusion 70*a* extending outwardly from the sidewall 64*a* to cooperate with an interior side of the outer tubular member 50*a* to form a spiral channel 72*a*. The spiral protrusion 70*a* may be formed in various shapes and angles. Additionally, more than one spiral protrusion may be employed.

The inner outer tubular member 52*a* is lowered through the tubing string 14 and landed in the outer tubular member 50*b*. The reservoir fluid passes through the apertures 128*a* of the outer tubular member 50*b* into an annulus 88*a* formed by the inner outer tubular member 52*a* and the outer tubular member 50*b*. The reservoir fluid is guided downwardly into the spiral channel 72*a* formed by the spiral protrusion 70*a* and the interior side of the outer tubular member 50*b*. The spiral channel 72*a* induces a cyclonic flow to the reservoir fluid, which causes heavier particles, such as sand and other solids, to be forced outwardly and fall to the lower end 82*a* of the outer tubular member 50*b*. The separated fluid flows into the bore 66*a* of the inner outer tubular member 52*a* via the lower end 62*a* of the inner outer tubular member 52*a*. The fluid continues to travel up through the bore 66*a* of the inner outer tubular member 52*a* and exits the desander assembly 22*c* via the cage 34*b*. The funnel-shaped bore 86 of the funnel section 54 promotes continued cyclonic flow of the solids.

While FIGS. 6-8 do not show a collector section, it will be understood that the desander assembly 22*c* may include any of the collector sections described above.

The desander assembly 22*c* may be used with a bottom bumper assembly positioned uphole of the desander assembly 22*c*. The desander assembly 22*c* may also be used with other types of artificial lift systems, such as gas lift systems, which are well known in the art. One of the features of the desander assembly 22*c* is that the inner outer tubular member 52*a* may be retrieved from the tubing string 14 without requiring the tubing string 14 to be pulled from the wellbore. The inner outer tubular member 52*a* may be retrieved from the tubing string 14 by latching onto the fishing neck 32*b* with a wireline or other suitable device.

Figure 9:
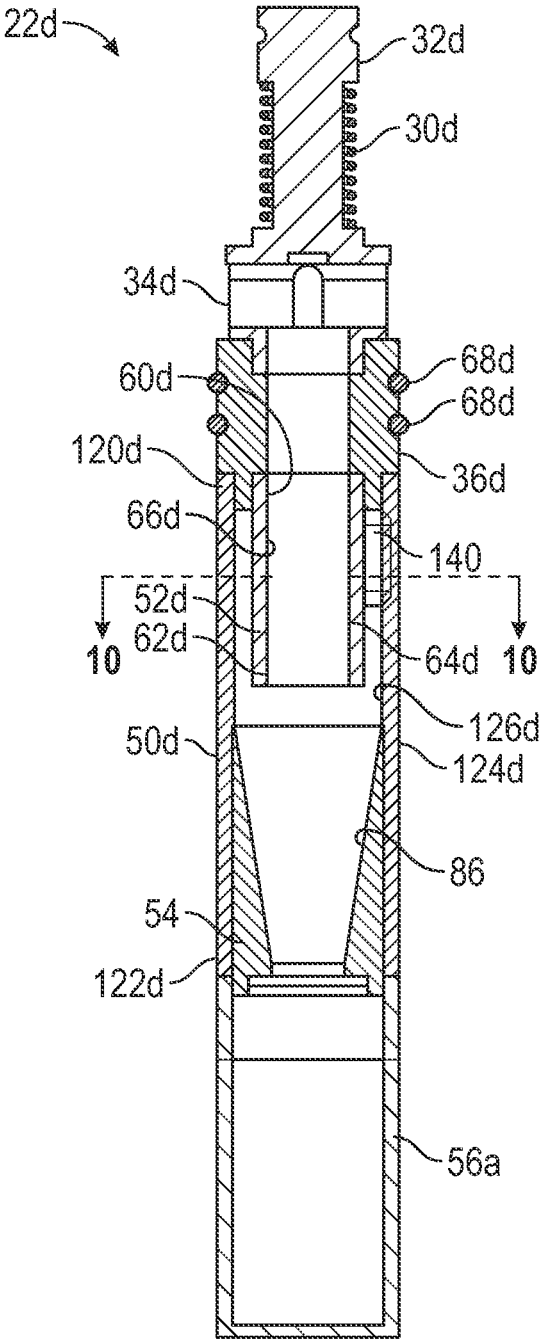
FIG. 9 is a sectional view of another embodiment of a desander assembly.
Figure 10:
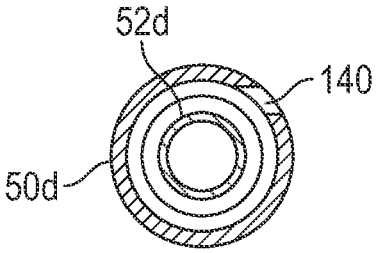
FIG. 10 is a cross-sectional view taken along line 10-10 of FIG. 9.

Referring now to FIGS. 9 and 10, another embodiment of a desander assembly 22*d* is illustrated. The desander assembly 22*d* is similar to the desander assembly 22*b*, except as noted below. The desander assembly 22*d* has an outer tubular member 50*d* with an upper end 120*d*, a lower end 122*d*, and a sidewall 124*d* defining a chamber 126*d* extending between the upper end 120*d* and the lower end 122*d*. The upper end 120*d* of the is connected to a lower end of a stop assembly 36*d*. The outer tubular member 50*d* differs from the outer tubular member 50-50*c* because the outer tubular member 50*d* has at least one aperture 140 extending therethrough near the upper end 120*d* thereof. The aperture 140 receives reservoir fluid from the reservoir.

As best shown in FIG. 10, the aperture 140 is angled so the reservoir entering the upper tubular member 50*d* is directed tangentially along the inner surface of the upper tubular member 50*d*, which induces a cyclonic flow to the reservoir fluid and causes heavier particles, such as sand and other solids, to be forced outwardly and fall to the lower end 122*d* of the outer tubular member 50*d*.

The desander assembly 22*d* further has an inner tubular member 52. The inner tubular member 52*d* has an upper end 60*d*, a lower end 62*d*, and a sidewall 64*d* defining a bore 66*d* extending between the upper end 60*d* and the lower end 62*d*. The upper end 60*d* of the inner tubular member 52*d* may be connected to an assembly of a fishing neck 32*d*, a cage or bypass tool 34*d*, a spring, and the stop assembly 36*d*, such as a seat cup, a collar stop, a tubing stop, or a collet latch. The stop assembly 36*d* may include at least one seal 68*d* to form a fluid-tight seal between the inner outer tubular member 52*d* and the outer tubular member 50*d*. The stop assembly 36*d* may be configured to retrievably mate with a profile nipple or, alternatively, in a tubing or collar stop or hold down device as used in lieu of a profile nipple. A standing valve (not shown) may be incorporated into the cage 34*d*.

Because the flow of reservoir fluid through the aperture 140 of the outer tubular member 50*d* induces cyclonic flow to the reservoir fluid, the inner tubular member 52*d* may have no spiral protrusion that would cooperate with an interior side of the outer tubular member 50*a* to form a spiral channel. It should be appreciated, however, that the inner tubular member 50*d* may be provided with one or more spiral protrusions as described above. The lower end 62*d* of the inner tubular member 52*d* is spaced a distance below the apertures 140 to create a U-shaped flow path from the chamber 126*d* (i.e., annulus) to the bore 66*d*.

The separated fluid flows into the bore 66*d* of the inner outer tubular member 52*d* via the lower end 62*d* of the inner outer tubular member 52*d*. The fluid continues to travel up through the bore 66*d* of the inner outer tubular member 52*d* and exits from the bypass tool 34*d*. The funnel-shaped bore 86 of the funnel section 54 promotes continued cyclonic flow for solids removal.

The desander assembly 22*d* is shown to include a collector section 56*a* described above. It will be appreciated that the desander assembly 22*d* may be configured alternatively to have a collector section 56.

One of the features of the desander assembly 22*d* is that it may be retrieved from the tubing string 14 without requiring the tubing string 14 to be pulled from the wellbore. The desander assembly 22*d* may be retrieved from the tubing string 14 by latching onto the fishing neck 32*d* with a wireline or other suitable device.

The desander assembly 22*d* is also capable of being used separately from a plunger lift assembly. By way of example, the desander assembly 22*d* may be incorporated into a tubing string below a pump, such as a sucker rod pump or an electric submersible pump (ESP).

It will be appreciated by those of ordinary skill in the art that connections between various components described herein may be threadedly connected to one another in a conventional fashion.

Although the presently disclosed inventive concepts have been described in conjunction with the specific language set forth herein above, many alternatives, modifications, and variations will be apparent to those skilled in the art. Accordingly, it is intended to embrace all such alternatives, modifications, and variations that fall within the spirit and broad scope of the presently disclosed inventive concepts. Changes may be made in the construction and the operation of the various components, elements, and assemblies described herein, without departing from the spirit and scope of the presently disclosed inventive concepts.

What is claimed is:

1. A desander assembly retrievably positionable in a tubing string, comprising:

a fishing neck;

a bypass tool having an internal bore and at least one aperture, the bypass member connected to the lower end of the fishing neck;

a spring positioned between the fishing neck and the bypass tool to permit reciprocating movement of the fishing neck relative to the bypass tool;

a stop assembly connected to the bypass tool, the stop assembly configured to retrievably mate with a portion of the tubing string;

an outer tubular member having an upper end, a lower end, and a sidewall defining a bore extending between the upper end and the lower end, the outer tubular member having at least one aperture extending therethrough in fluid communication with the bore, the upper end of the outer tubular member connected to the stop assembly; and an inner tubular member with an upper end, a lower end, and a sidewall defining a bore extending between the upper end and the lower end, the upper end of the inner tubular member connected to the stop assembly with the inner tubular member positioned in the outer tubular member to form an annulus and so the bore of the inner tubular member is in fluid communication with the bypass tool, the inner tubular member having at least one spiral protrusion extending outwardly from the sidewall to cooperate with an interior side of the outer tubular member to form a spiral channel, wherein the bore of the inner tubular member receives reservoir fluid that passes into the annulus formed between the inner tubular member and the outer tubular member via the apertures of the outer tubular member, the reservoir fluid guided downwardly into the spiral channel so the spiral channel induces a cyclonic flow, which causes heavier particles to be forced outwardly and to fall to the lower end of the funnel section, the separated fluid flows into the bore of the inner tubular member via the lower end of the inner tubular member so the fluid continues to travel up through the bore of the inner tubular member and exit from the bypass tool.

2. The desander assembly of claim 1, wherein a lower portion of the outer tubular member includes a funnel-shaped bore.

3. The desander assembly 1, further comprising a collector section having an upper end connected to the lower end of the outer tubular member.

4. The desander assembly of claim 3, wherein the collector section comprises a dump valve.

5. The desander assembly of claim 3, wherein the collector section comprises a tubular member having an upper end, a closed lower end, and a sidewall defining a chamber extending between the upper end and the lower end, the upper end of the collector section connected to the lower end of the outer tubular member.

6. A desander assembly retrievably positionable in a tubing string, comprising:

a fishing neck;

a bypass tool having an internal bore and at least one aperture, the bypass member connected to the lower end of the fishing neck;

a stop assembly connected to the bypass tool, the stop assembly configured to retrievably mate with a portion of the tubing string;

an outer tubular member having an upper end, a lower end, and a sidewall defining a bore extending between the upper end and the lower end, the outer tubular member having at least one aperture extending therethrough in fluid communication with the bore, the upper end of the outer tubular member connected to the stop assembly; and an inner tubular member having an upper end, a lower end, and a sidewall defining a bore extending between the upper end and the lower end, the upper end of the inner tubular member connected to the stop assembly with the inner tubular member positioned in the outer tubular member to form an annulus and so the bore of the inner tubular member is in fluid communication with the bypass tool, the inner tubular member having at least one spiral protrusion extending outwardly from the sidewall to cooperate with an interior side of the outer tubular member to form a spiral channel, wherein the bore of the inner tubular member receives reservoir fluid that passes into the annulus formed between the inner tubular member and the outer tubular member via the apertures of the outer tubular member, the reservoir fluid guided downwardly into the spiral channel so the spiral channel induces a cyclonic flow, which causes heavier particles to be forced outwardly and to fall to the lower end of the funnel section, the separated fluid flows into the bore of the inner tubular member via the lower end of the inner tubular member so the fluid continues to travel up through the bore of the inner tubular member and exit from the bypass tool.

7. The desander assembly of claim 6, wherein a lower portion of the outer tubular member includes a funnel-shaped bore.

8. The desander assembly of claim 6, further comprising a collector section having an upper end connected to the lower end of the outer tubular member.

9. The desander assembly of claim 8, wherein the collector section comprises a dump valve.

10. The desander assembly of claim 8, wherein the collector section comprises a tubular member having an upper end, a closed lower end, and a sidewall defining a chamber extending between the upper end and the lower end, the upper end of the collector section connected to the lower end of the outer tubular member.

11. A desander assembly retrievably positionable in a tubing string, a portion of the tubing string having at least one aperture extending therethrough, the desander assembly comprising:

a fishing neck;

a bypass tool having an internal bore and at least one aperture, the bypass member connected to the lower end of the fishing neck;

a stop assembly connected to the bypass tool, the stop assembly configured to retrievably mate with a portion of the tubing string; and an inner tubular member having an upper end, a lower end, and a sidewall defining a bore extending between the upper end and the lower end, the upper end of the inner tubular member connected to the stop assembly with the inner tubular member positionable in the portion of the tubing string to form an annulus and so the bore of the inner tubular member is in fluid communication with the bypass tool, the inner tubular member having at least one spiral protrusion extending outwardly from the sidewall to cooperate with an interior side of the portion of the tubing string to form a spiral channel, wherein the bore of the inner tubular member receives reservoir fluid that passes into the annulus formed between the inner tubular member and the tubing string via the apertures of the tubing string, the reservoir fluid guided downwardly into the spiral channel so the spiral channel induces a cyclonic flow, which causes heavier particles to be forced outwardly and to fall to the lower end of the funnel section, the separated fluid flows into the bore of the inner tubular member via the lower end of the inner tubular member so the fluid continues to travel up through the bore of the inner tubular member and exit from the bypass tool.

12. The desander assembly of claim 11, wherein the portion of the tubing string includes a funnel-shaped bore.

13. The desander assembly of claim 11, further comprising a collector section having an upper end connected to the lower end of the tubing string.

14. The desander assembly of claim 13, wherein the collector section comprises a dump valve.

15. The desander assembly of claim 13, wherein the collector section comprises a tubular member having an upper end, a closed lower end, and a sidewall defining a chamber extending between the upper end and the lower end, the upper end of the collector section connected to the lower end of the outer tubular member.

16. A desander assembly incorporated a tubing string, comprising:

an outer tubular member having an upper end, a lower end, and a sidewall defining a bore extending between the upper end and the lower end, the outer tubular member having at least one aperture extending therethrough in fluid communication with the bore, the upper end of the outer tubular member supported by a portion of the tubing string; and an inner tubular member having an upper end, a lower end, and a sidewall defining a bore extending between the upper end and the lower end, the upper end of the inner tubular member supported by the portion of the tubing string with the inner tubular member positioned in the outer tubular member to form an annulus and so the bore of the inner tubular member is in fluid communication with tubing string, the lower end of the inner tubular member being spaced a distance below the at least one aperture of the outer tubular member, wherein the bore of the inner tubular member receives reservoir fluid that passes into the annulus formed between the inner tubular member and the outer tubular member via the aperture of the outer tubular member, the reservoir fluid directed tangentially into the outer tubular member to induce a cyclonic flow, which causes heavier particles to be forced outwardly and to fall to the lower end of the outer tubular member, the separated fluid flows into the bore of the inner tubular member via the lower end of the inner tubular member so the fluid continues to travel up through the bore of the inner tubular member and the tubing string.

17. The desander assembly of claim 16, wherein a lower portion of the outer tubular member includes a funnel-shaped bore.

18. The desander assembly of claim 17, further comprising:

a fishing neck;

a bypass tool having an internal bore and at least one aperture, the bypass member connected to the lower end of the fishing neck; and a stop assembly connected to the bypass tool, the stop assembly configured to retrievably mate with the portion of the tubing string.

19. The desander assembly of claim 18, wherein the collector section comprises an outer tubular member having an upper end, a closed lower end, and a sidewall defining a chamber extending between the upper end and the lower end, the upper end of the collector section connected to the lower end of the outer tubular member.

20. The desander assembly of claim 16, further comprising a collector section having an upper end connected to the lower end of the outer tubular member.

* * * * *